US011332701B2

(12) United States Patent
Somerville Roberts et al.

(10) Patent No.: US 11,332,701 B2
(45) Date of Patent: May 17, 2022

(54) WATER-SOLUBLE UNIT DOSE ARTICLE COMPRISING A SOLID LAUNDRY DETERGENT COMPOSITION

(71) Applicant: The Procter & Gamble Company, Cincinnati, OH (US)

(72) Inventors: Nigel Patrick Somerville Roberts, Northumberland (GB); Alan Thomas Brooker, Newcastle upon Tyne (GB); Carly Pickering, Tyne & Wear (GB); Katie Marie Perrie, Glasgow (GB); Robby Renilde François Keuleers, Lippelo (BE); Ned Peter Buijs, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 206 days.

(21) Appl. No.: 16/005,723

(22) Filed: Jun. 12, 2018

(65) Prior Publication Data

US 2018/0362902 A1 Dec. 20, 2018

(30) Foreign Application Priority Data

Jun. 15, 2017 (EP) ..... 17176188

(51) Int. Cl.

| | |
|---|---|
| ***C11D 17/04*** | (2006.01) |
| ***C11D 17/06*** | (2006.01) |
| ***C11D 1/22*** | (2006.01) |
| ***C11D 1/29*** | (2006.01) |
| ***C11D 1/37*** | (2006.01) |
| ***C11D 3/04*** | (2006.01) |
| ***C11D 3/12*** | (2006.01) |
| ***C11D 17/00*** | (2006.01) |
| ***C11D 1/14*** | (2006.01) |
| ***C11D 1/83*** | (2006.01) |
| ***C11D 11/00*** | (2006.01) |
| ***C11D 11/02*** | (2006.01) |

(52) U.S. Cl.

CPC ..... *C11D 17/045* (2013.01); *C11D 1/143* (2013.01); *C11D 1/146* (2013.01); *C11D 1/83* (2013.01); *C11D 3/046* (2013.01); *C11D 3/124* (2013.01); *C11D 11/0017* (2013.01); *C11D 11/02* (2013.01); *C11D 17/0039* (2013.01); *C11D 17/044* (2013.01); *C11D 17/06* (2013.01)

(58) Field of Classification Search

None

See application file for complete search history.

(56) References Cited

U.S. PATENT DOCUMENTS

| | | | | |
|---|---|---|---|---|
| 5,132,036 | A | 7/1992 | Falou et al. | |
| 6,794,354 | B1 * | 9/2004 | Mort, III | C11D 11/0082 264/117 |
| 6,878,679 | B2 | 4/2005 | Sommerville-Roberts et al. | |
| 7,386,971 | B2 | 6/2008 | Catlin et al. | |
| 7,595,290 | B2 | 9/2009 | Pounds et al. | |
| 10,501,711 | B2 * | 12/2019 | Somerville Roberts | C11D 1/37 |
| 10,550,357 | B2 * | 2/2020 | Somerville Roberts | C08L 71/00 |
| 2003/0087784 | A1 | 5/2003 | Somervile-Roberts et al. | |
| 2003/0092590 | A1 * | 5/2003 | Dasque | B65B 11/50 510/296 |
| 2003/0114333 | A1 | 6/2003 | Somerville-Roberts et al. | |
| 2003/0119696 | A1 * | 6/2003 | Ingram | C11D 1/72 510/296 |
| 2003/0232734 | A1 * | 12/2003 | Kitko | C11D 3/3932 510/311 |
| 2004/0035739 | A1 * | 2/2004 | Hammond | B65B 9/04 206/524.1 |
| 2005/0229260 | A1 | 10/2005 | Feichtinger et al. | |
| 2006/0213801 | A1 * | 9/2006 | Karaoren | C11D 17/042 206/524.7 |
| 2008/0004202 | A1 * | 1/2008 | Wolfgang | C11D 17/0078 510/439 |
| 2009/0011970 | A1 | 1/2009 | Evers | |
| 2015/0267155 | A1 | 9/2015 | Brooker et al. | |
| 2015/0275157 | A1 | 10/2015 | Souter et al. | |
| 2016/0040101 | A1 * | 2/2016 | De Poortere | C11D 1/22 510/296 |
| 2016/0040105 | A1 | 2/2016 | Depoot et al. | |
| 2016/0130538 | A1 * | 5/2016 | Cooley | C11D 17/045 8/137 |
| 2016/0177236 | A1 | 6/2016 | Brooker et al. | |
| 2016/0348044 | A1 | 12/2016 | Smith et al. | |
| 2018/0094212 | A1 | 4/2018 | Chieffi et al. | |
| 2018/0094215 | A1 | 4/2018 | Chieffi et al. | |
| 2018/0094219 | A1 | 4/2018 | Chieffi et al. | |
| 2018/0094220 | A1 | 4/2018 | Chieffi et al. | |
| 2018/0094221 | A1 | 4/2018 | Chieffi et al. | |

(Continued)

FOREIGN PATENT DOCUMENTS

| | | |
|---|---|---|
| EP | 3301145 A1 | 4/2018 |
| EP | 3301146 A1 | 4/2018 |

(Continued)

OTHER PUBLICATIONS

U.S. Appl. No. 16/005,724, filed Jun. 12, 2018, Nigel Patrick Someville Roberts.

U.S. Appl. No. 16/005,726, filed Jun. 12, 2018, Nigel Patrick Someville Roberts.

CM4788-EP Search Report for application No. 17176223.0-1358, dated Nov. 27, 2017, 12 pages.

Search Report foe application No. 17176195.0-1358, dated Dec. 13, 2017, 7 pages.

(Continued)

*Primary Examiner* — Lorna M Douyon

(74) *Attorney, Agent, or Firm* — Gregory S. Darley-Emerson

(57) ABSTRACT

Water-soluble unit dose article containing solid laundry detergent composition and water-soluble film.

15 Claims, 1 Drawing Sheet

(56) References Cited

U.S. PATENT DOCUMENTS

| | | | |
|---|---|---|---|
| 2018/0094222 | A1 | 4/2018 | Chieffi et al. |
| 2018/0094223 | A1 | 4/2018 | Chieffi et al. |
| 2018/0094224 | A1 | 4/2018 | Chieffi et al. |
| 2018/0094225 | A1 | 4/2018 | Chieffi et al. |
| 2018/0094228 | A1 | 4/2018 | Chieffi et al. |

FOREIGN PATENT DOCUMENTS

| | | | |
|---|---|---|---|
| EP | 3301147 | A1 | 4/2018 |
| EP | 3301148 | A1 | 4/2018 |
| EP | 3301149 | A1 | 4/2018 |
| EP | 3301158 | A1 | 4/2018 |
| EP | 3301160 | A1 | 4/2018 |
| EP | 3301161 | A1 | 4/2018 |
| EP | 3301169 | A1 | 4/2018 |
| WO | 0183667 | A1 | 11/2001 |
| WO | 0183669 | A1 | 11/2001 |
| WO | 03044155 | A1 | 5/2003 |

OTHER PUBLICATIONS

All Office Actions, U.S. Appl. No. 16/005,724.
All Office Actions, U.S. Appl. No. 16/005,726.
International Search Report and Written Opinion; Application No. US2018/036835; dated Aug. 24, 2018, 10 pages.

* cited by examiner

WATER-SOLUBLE UNIT DOSE ARTICLE COMPRISING A SOLID LAUNDRY DETERGENT COMPOSITION

FIELD OF THE INVENTION

The present invention relates to water-soluble unit dose articles containing solid laundry detergent compositions and methods of using them.

BACKGROUND OF THE INVENTION

Water-soluble laundry unit dose articles are known and are liked by consumers due to their ease and efficiency of use in the laundry operation. Water-soluble unit dose articles comprise water-soluble film defining at least one internal compartment. A laundry detergent composition is housed within the internal compartment. Upon exposure to water, the water-soluble film dissolves/disintegrates releasing the laundry detergent composition into the surrounding water.

The laundry detergent composition may be a solid particulate detergent composition. Such detergent compositions comprise non-soap anionic surfactants as the primary cleaning active and may comprise other common detergent ingredients.

An issue associated with such water-soluble unit dose articles is the efficient and effective dissolution of the solid particulate composition in water following addition of the water-soluble unit dose article to said water. Often, the solid particulate laundry detergent composition does not fully dissolve in water and this can be further exacerbated by the solid particulate detergent composition interacting with the film and retarding its dissolution. This results in partially undissolved unit dose article and/or laundry detergent composition at the end of the wash which can cause residues on fabrics. This is especially observed under difficult wash conditions, for example when a unit dose article gets wrapped between fabrics and as such experiences minimal water exposure. Short and cold water cycles further stress dissolution of the water soluble unit dose article and the solid detergent enclosed therein.

It was surprisingly found that the instances of fabric residues following the wash operation was reduced if the solid particulate laundry detergent composition was formulated in the water-soluble unit dose article as a free-flowing particulate solid as opposed to a solid tablet or compressed particulate solid as seen in products currently on the market. Without wishing to be bound by theory, known water-soluble unit dose articles are formulated such that the solid particulate laundry detergent is added to the compartment and then excess air in the compartment is drawn out typically through pin-pricking the water soluble film and applied vacuum/under-pressure so compressing the solid within the compartment and so rendering the particulate solid being no longer free to move within the compartment when the unit dose article is repositioned. The present invention allows for the free movement of the individual solid laundry detergent particles as the water-soluble unit dose article is moved/handled/repositioned.

SUMMARY OF THE INVENTION

A first aspect of the present invention is a water-soluble unit dose article comprising a water-soluble film and a solid particulate laundry detergent composition, wherein the water-soluble film defines a first internal compartment; and wherein the solid particulate laundry detergent composition is comprised within the first internal compartment; and wherein the solid particulate laundry detergent composition is free flowing within the first internal compartment; and wherein the solid particulate laundry detergent composition comprises a non-soap surfactant.

A second aspect of the present invention is a method of washing comprising the steps of adding the water-soluble unit dose article according to the present invention to sufficient water to dilute the solid particulate laundry detergent composition by a factor of at least 300 fold to create a wash liquor and contacting fabrics to be washed with said wash liquor.

A third aspect of the present invention is the use of non-soap surfactant comprising free flowing powder in a water-soluble unit dose detergent pouch to reduce detergent residues on fabrics during the wash operation.

DETAILED DESCRIPTION OF THE INVENTION

Water-Soluble Unit Dose Article

Figure 1:
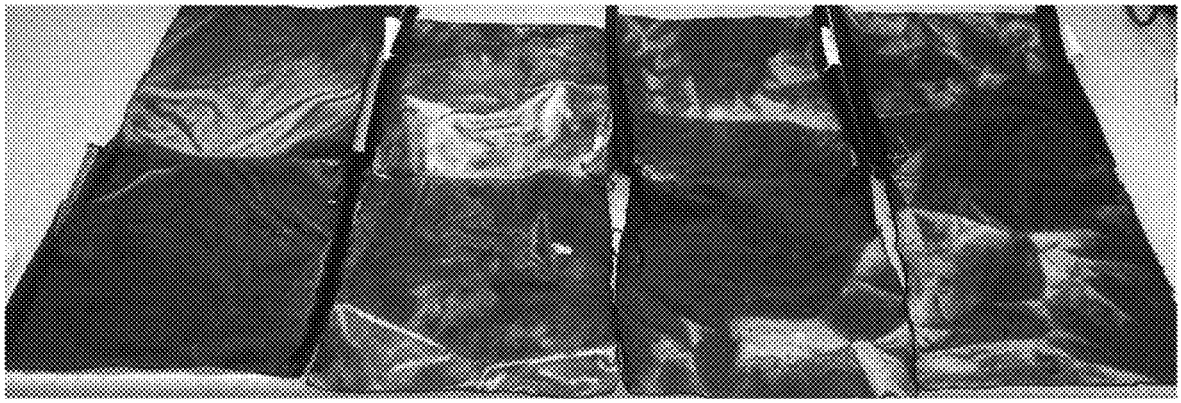
FIG. 1 Black Velvet pouch test using comparative water-soluble unit dose article.
Figure 2:
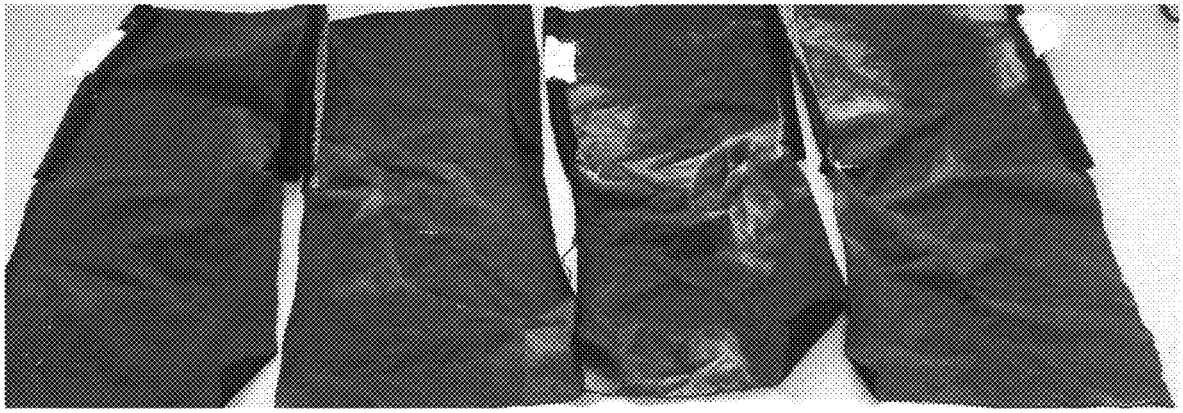
FIG. 2 Black Velvet pouch test using water-soluble unit dose article according to present invention.

The present invention is to a water-soluble unit dose article comprising a water-soluble film and a solid particulate laundry detergent composition.

The water-soluble film is described in more detail below.

The solid particulate laundry detergent composition is described in more detail below.

The water-soluble unit dose article comprises the water-soluble film shaped such that the unit-dose article comprises at least a first internal compartment surrounded by the water-soluble film. The compartment should be understood as meaning a closed internal space within the unit dose article, which holds the solid laundry detergent composition. The unit dose article may comprise a first water-soluble film and a second water-soluble film sealed to one another such to define the internal compartment. The water-soluble unit dose article is constructed such that the solid laundry detergent composition is comprised within the first internal compartment. The water-soluble unit dose article is constructed such that the solid laundry detergent composition does not leak out of the compartment during storage. However, upon addition of the water-soluble unit dose article to water, the water-soluble film dissolves and releases the contents of the internal compartment into the wash liquor.

During manufacture, a first water-soluble film may be shaped to comprise an open compartment into which the solid laundry detergent composition is added. A second water-soluble film is then laid over the first film in such an orientation as to close the opening of the compartment. The first and second films are then sealed together along a seal region.

The unit dose article may comprise more than one compartment, even at least two compartments, or even at least three compartments. The compartments may be arranged in superposed orientation, i.e. one positioned on top of the other. In such an orientation the unit dose article will comprise at least three films, top, middle and bottom. Alternatively, the compartments may be positioned in a side-by-side orientation, i.e. one orientated next to the other.

The compartments may even be orientated in a 'tyre and rim' arrangement, i.e. a first compartment is positioned next to a second compartment, but the first compartment at least partially surrounds the second compartment, but does not completely enclose the second compartment. Alternatively one compartment may be completely enclosed within another compartment.

Wherein the unit dose article comprises at least two compartments, one of the compartments may be smaller than the other compartment. Wherein the unit dose article comprises at least three compartments, two of the compartments may be smaller than the third compartment, and preferably the smaller compartments are superposed on the larger compartment. The superposed compartments preferably are orientated side-by-side.

In a multi-compartment orientation, the detergent composition according to the present invention may be comprised in at least one of the compartments. It may for example be comprised in just one compartment, or may be comprised in two compartments, or even in three compartments.

Each compartment may comprise the same or different compositions. The different compositions could all be in the same form, or they may be in different forms.

The water-soluble unit dose article may comprise at least a first compartment and a second compartment, preferably at least a first compartment, a second compartment and a third compartment. Preferably, the compartments are arranged in a side-by-side arrangement, a superposed arrangement or a mixture thereof. Preferably, at least the second compartment, more preferably at least the second compartment and the third compartment are superposed onto the first compartment. The second compartment and the third compartment are preferably arranged in a side-by-side arrangement superposed onto the first compartment.

The first i.e. bottom compartment preferably comprises the free flowing solid detergent composition. The second and subsequent compartments i.e. superposed compartments comprise a liquid, a solid or a mixture thereof, preferably a liquid. All compartments might comprise a gas in addition to the enclosed compositions, preferably will comprise a gas. Without wishing to be bound by theory, such a gas will create an 'air space' in the compartment and will facilitate free flowing of the enclosed compositions, and furthermore can act as an additional barrier against eventual compartment to compartment active migration through the film. Preferably the gas is air. Further this particular design can also enable the use of a thinner water soluble film orientated between the bottom and the subsequent superposed compartments of the water soluble unit dose article. Such thinner film is preferred for reduced manufacturing use of material, environmental exposure and residue on fabric risk reduction at the end of the wash process.

Water-Soluble Film

The film of the present invention is soluble or dispersible in water. The water-soluble film preferably has a thickness of from 20 to 150 micron, preferably 35 to 125 micron, even more preferably 50 to 110 micron, most preferably about 76 micron.

Preferably, the film has a water-solubility of at least 50%, preferably at least 75% or even at least 95%, as measured by the method set out here after using a glass-filter with a maximum pore size of 20 microns: 5 grams±0.1 gram of film material is added in a pre-weighed 3 L beaker and 2 L±5 ml of distilled water is added. This is stirred vigorously on a magnetic stirrer, Labline model No. 1250 or equivalent and 5 cm magnetic stirrer, set at 600 rpm, for 30 minutes at 30° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Mixtures of polymers and/or copolymers can also be used as the pouch material, especially mixtures of polyvinylalcohol polymers and/or copolymers, especially mixtures of polyvinylalcohol homopolymers and/or anionic polyvinylalcohol copolymers preferably selected from sulphonated and carboxylated anionic polyvinylalcohol copolymers especially carboxylated anionic polyvinylalcohol copolymers. Most preferably the water soluble film comprises a blend of a polyvinylalcohol homopolymer and a carboxylated anionic polyvinylalcohol copolymer.

Preferred films exhibit good dissolution in cold water, meaning unheated distilled water. Preferably such films exhibit good dissolution at temperatures of 24° C., even more preferably at 10° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol under the trade references M8630, M8900, M8779, M8310.

The film may be opaque, transparent or translucent. The film may comprise a printed area.

The area of print may be achieved using standard techniques, such as flexographic printing or inkjet printing.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 rpm.

Solid Laundry Detergent Composition

The first internal compartment comprises a solid particulate laundry detergent composition. This means the solid laundry detergent composition comprises individual solid particles as opposed to the solid being a single homogenous solid.

The particles are spray-dried particles, agglomerates, extrudates or a mixture thereof. Those skilled in the art will know how to make spray-dried particles, agglomerates or extrudates using techniques commonly known in the art.

The solid particulate laundry detergent composition preferably has a mean particle size of between 400 microns and 1000 microns, more preferably between 450 microns and 850 microns.

Preferably, the solid particulate laundry detergent composition has a bulk density of between 400 and 1000 g/l, more preferably between 500 and 800 g/l, as measured through ISO 697 test method.

Preferably, the solid particulate laundry detergent composition fills between 25% and 95%, preferably between 30% and 90%, more preferably between 40% and 80% of the available volume within the first compartment, the remaining volume preferably filled with a gas. The gas may be any suitable gas. The gas may comprise oxygen, nitrogen, carbon dioxide or a mixture thereof. The gas may be air.

The first compartment preferably comprises between 1 g and 25 g, preferably between 5 g and 20 g, more preferably between 8 g and 18 g of the solid particulate laundry composition.

The solid particulate laundry detergent composition is free flowing within the first internal compartment. That is to say if the water-soluble unit dose article is moved or repositioned, the solid particulate laundry detergent composition can be seen to freely move, or flow within the first internal compartment. This is opposed to where the solid particulate laundry detergent composition is compressed such as happens when excess air is drawn out of the first internal compartment so that the film contracts and compresses around the solid particulate laundry detergent composition. Such water-soluble unit dose articles comprising compressed solids are commonly known from the art.

The solid particulate laundry detergent composition comprises a non-soap surfactant. Preferably, the solid laundry detergent composition comprises between 20% and 75%, more preferably between 30% and 70%, most preferably between 40% and 60% by weight of the solid laundry detergent composition of the non-soap surfactant. Without wishing to be bound by theory, the combination of the non-soap surfactant in combination with the free flowing particulate laundry detergent composition provides for best cleaning performance with reduced fabric residue risk compared to compacted or compressed non-soap surfactant comprising powder. If a liquid composition is also present within a further compartment of the unit dose article, preferably the liquid composition comprises less than 20%, preferably less than 10%, more preferably less than 5% by weight of the liquid composition of a surfactant. Preferably all surfactant will be present within the solid particulate laundry detergent composition.

The non-soap surfactant may comprise a non-soap anionic surfactant, a non-ionic surfactant or a mixture thereof, preferably a non-soap anionic surfactant. Preferably, the solid laundry detergent composition comprises between 20% and 75%, more preferably between 30% and 70%, most preferably between 40% and 60% by weight of the solid laundry detergent composition of the non-soap anionic surfactant.

Preferably, the non-soap anionic surfactant comprises linear alkylbenzene sulphonate, alkoxylated alkyl sulphate or a mixture thereof, more preferably a mixture thereof. Preferably, the ratio of linear alkylbenzene sulphonate to alkoxylated alkyl sulphate preferably the ratio of linear alkylbenzene sulphonate to ethoxylated alkyl sulphate is from 1:2 to 20:1, preferably from 1.1:1 to 15:1, more preferably from 1.2:1 to 10:1, even more preferably from 1.3:1 to 5:1, even more preferably from 1.4:1 to 3:1, most preferably from 2:1 to 3:1.

Preferably, the alkoxylated alkyl sulphate is an ethoxylated alkyl sulphate with an average degree of ethoxylation of between 0.5 and 7, preferably between 0.5 and 5, more preferably between 0.5 and 3, even more preferably from 1 to 2 most preferably 1 and preferably an average alkyl chain length of between 8 and 18. Preferably the alkoxylated alkyl sulphate has an average alkyl chain length between 10 and 16, more preferably between 12 and 14. Preferably, the linear alkylbenzene sulphonate is a $C_{10}$-$C_{16}$ linear alkylbenzene sulphonate or a $C_{11}$-$C_{14}$ linear alkylbenzene sulphonate or a mixture thereof.

When present, preferably the non-ionic surfactant is selected from an alkoxylated alcohol preferably selected from a natural or olefin derived fatty alcohol alkoxylate, an oxo-synthesised fatty alcohol alkoxylate, Guerbet fatty alcohol alkoxylates, alkyl phenol alcohol alkoxylates or a mixture thereof. The alcohol alkoxylate may have an average degree of alkoxylation of between 0.5 and 10, preferably between 1 and 9, more preferably between 3 and 8, more preferably a degree of ethoxylation of between 0.5 and 10, preferably between 1 and 9, more preferably between 3 and 8, most preferably between 5 and 8 or even from about 7 to about 8. The alcohol alkoxylate may have an average alkyl chain length of between 8 and 18, preferably between 10 and 16, more preferably between 12 and 15.

The solid particulate laundry detergent composition preferably comprises an adjunct ingredient. Preferably, the adjunct ingredient is selected from cationic polymers, brightener, dye transfer inhibitors, chelants including aminocarboxylate and aminophosphonate chelants such as HEDP, enzymes, acrylate-based polymers, perfumes, perfume capsules, polyester terephthalate polymers, PEG-based polymers, ethoxylated polyethyleneimines, polysaccharides, amine oxide, aesthetic dyes, hueing dyes, antifoams, bleaching actives, or a mixture thereof, more preferably, cationic polymers, brightener, chelants, enzymes, acrylate-based polymers, perfumes or a mixture thereof. Without wishing to be bound by theory, the combination of the adjunct ingredient in combination with the free flowing particulate laundry detergent composition provides for best fabric treatment performance. The solid particulate laundry detergent composition may also comprise some absorbed/adsorbed water. Preferably the solid particulate laundry detergent composition also comprises a bleaching active. Without wishing to be bound by theory the free flowing powder is believed to provide faster release of the bleaching active from the unit dose article, positively impacting bleach sensitive stain removal accordingly.

The polysaccharide is preferably a carboxymethylcellulose.

Preferred acrylate-based polymers are acrylate/maleate random copolymers.

Preferred cationic polymer are cationically-modified polysaccharides. Preferably, the cationically modified polysaccharide is selected from cationic guar gums, cationic cellulosic polymers, and mixtures thereof, most preferably cationic cellulosic polymers even more preferably cationically modified hydroxyethyl cellulose, most preferably, hydroxyethyl cellulose derivatised with trimethyl ammonium substituted epoxide.

Preferably, the solid particulate laundry detergent composition at 1 wt % dilution in deionized water at 20° C. has an equilibrium pH in the range of from 6.5 to 8.8, preferably between 6.7 and 8.5, more preferably between 7 and 8. Without wishing to be bound by theory, the specific lower pH provides for optimal performance of the non-soap surfactant and the adjunct ingredients.

Preferably, the solid laundry detergent composition comprises a material selected from zeolite, sodium carbonate, sodium bicarbonate, sodium sulphate, silica, organic acid or a mixture thereof. The solid laundry detergent composition may comprise between 15% and 40%, more preferably between 18% and 30% by weight of the solid laundry detergent composition of the material. The solid laundry detergent composition may comprise a material selected from sodium carbonate, potassium carbonate, sodium bicarbonate, sodium bicarbonate, burkeite, sequicarbonate, habit modified carbonate, crystal growth modified burkeite or a mixture thereof, preferably sodium carbonate. The solid laundry detergent composition may comprise between 15% and 40%, more preferably between 18% and 30% by weight of the solid laundry detergent composition of the material. Without wishing to be bound by theory such materials may be used to control the pH of the laundry detergent composition.

The solid laundry detergent composition may comprise an organic acid, preferably between 1% and 10% by weight of the solid laundry detergent composition of an organic acid and/or a salt thereof. Preferably, the organic acid is a carboxylic acid, preferably a polycarboxylic acid, more preferably the organic acid is selected from citric acid, malic acid, lactic acid, propionic acid, valeric acid, caproic acid, carbonic acid, adipic acid, gluconic acid, methylglycinediacetic acid or a mixture thereof, most preferably citric acid. Without wishing to be bound by theory such materials may be used to control the pH of the laundry detergent composition.

Preferably, the particulate laundry detergent composition comprises agglomerates. Preferably, the agglomerates comprise non-soap surfactant, sodium sulphate and silica. Preferably said agglomerates further comprise a polymer preferably selected from acrylate homopolymers, acrylate/maleate copolymers or mixtures thereof. Without wishing to be bound by theory it is believed the addition of the polymer will provide for a harder agglomerate which is less susceptible for breakage prior to use.

A further aspect of the present invention is the use of non-soap surfactant comprising free flowing powder according to the present invention in a water-soluble unit dose article to reduce detergent residues on fabrics during the wash operation.

Method of Washing

An aspect of the present invention is a method of washing comprising the steps of adding the water-soluble unit dose article according to the present invention to sufficient water to dilute the solid particulate laundry detergent composition by a factor of at least 300 fold to create a wash liquor and contacting fabrics to be washed with said wash liquor.

The method may be performed in a hand wash operation, an automatic laundry washing machine or a mixture thereof.

Process of Making

Those skilled in the art will know how to make the unit dose article and particulate laundry detergent composition of the present invention using known techniques in the art:

Water Soluble Pouch Making:

During manufacture, a first water-soluble film may be shaped to comprise an open compartment into which the detergent composition is added. A second water-soluble film is then laid over the first film in such an orientation as to close the opening of the compartment. The first and second films are then sealed together along a seal region using known sealing means such as solvent, heat or a mixture thereof.

Preparation of Free-Flowing Detergent Powders:

Highly preferred are free-flowing detergent powders. Without wishing to be bound by theory, free-flowing detergent powders are found to have improved dissolution when formulated in a water soluble pouch compared to compressed powders, leaving less detergent residues behind accordingly. Highly free-flowing detergent powders can be prepared by the following process.

Surfactant-containing particles can be prepared by spray-drying, agglomeration or other processes such as drum drying etc. Such agglomerates are preferred due to the high surfactant loading that can be achieved. However other processes can be used. The surfactant agglomerates preferably contain anionic surfactant, including LAS. An especially preferred feature is that the surfactant agglomerates contain a mixture of anionic surfactants, especially LAS and AES surfactant.

To improve the flowability and stability of the detergent powder(s), smaller particles are usually removed by sieving. It is especially preferred to sieve the surfactant agglomerates plus other detergent ingredients prior to any subsequent coating step. The surfactant agglomerates, plus other granular detergent ingredients such as HEDP, are sieved to remove particles smaller than 600 microns. The surfactant particles, plus any other detergent ingredients that are optionally added, are then put into a mixer where they are dusted or coated with a fine powder to provide a protective layer on the surface. An example of such a process is where blown powders are coated with non-ionic surfactant as a binder and then zeolite. It has been found, though, that dusting or coating the surfactant agglomerates (and other optional detergent ingredients) in this instance with a blend of micronized sodium sulphate and zeolite gives good results for flowability as well as appearance etc. Inclusion of a liquid binder to help the adhesion of the fine powder(s) to the surface of the larger surfactant agglomerates is also an option.

A suitable detergent mix can be prepared as follows. Surfactant agglomerates containing a blend of LAS and AExS anionic surfactants are prepared and dried to give particles with a total surfactant activity of 60% comprising a 2:1 blend of LAS to AExS surfactants. The particles contain 20% of hydrophilic silica. A suitable silica is 22S from Evonik. The balance consists of ground sodium sulphate, water and miscellaneous. The fine particles are then removed by sieving the agglomerates on a 600 micron mesh sieve. Oversize particles are removed by sieving the agglomerates through a 1400 micron mesh size sieve.

3 kg of the sieved surfactant agglomerates are then put into a 6-litre internal volume paddle mixer from Forberg. 300 g of ground sodium sulphate (d90<100 microns) and 100 g of sodium aluminosilicate type 4A are then added to the mixer and the mixer is run at maximum speed for 2 minutes, thus coating the surface of the agglomerates with sulphate and zeolite. The coated agglomerates are then removed and blended with other detergent materials to give a free-flowing detergent mixture suitable for use.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

EXAMPLES

The amount of detergent residue on fabrics has been defined for a water soluble unit dose article comprising a free flowing detergent powder composition single variably comparing with a water soluble unit dose article comprising a non-free flowing detergent powder composition.

Test Method:

In order to demonstrate the impact of having a free flowing powder as a pose to a non-free flowing powder contained within a pouch on dissolution performance, a full scale dissolution test has been conducted. A wool cycle at 40° C. and 6 gpg water hardness was selected on a Miele washing machine (model 3622), total run time was 39 minutes. Reference and Test pouched products were placed inside Black Velvet Pouches (sourced from Warwick Equest Ltd. Unit 55, Consett Business Park, Consett, County Durham, DH8 6BN, Material type 150 cm C. R. Cotton Pile Velvet, quality 8897, black, 72% Cotton, 28% Modal, sourced from Denholme Velvets, Halifax Road, Denholme, Bradford, West Yorkshire, England BD13 4EZ) and stitched using an overlock stich along a folded seam of 2 cm, sealing the open end. 4 black velvet pouches were then placed inside the washing machine on the bottom of the drum overlapping one another (2 Reference Product/2 Test Product). The dissolution test is repeated on 2 washing machines and one wash cycle was carried out in both machines with no extra ballast or soil. The Black Velvet pouches were removed after the wash cycle was complete, cut along the 3 stitched edges, opened and graded for residues by 3 panelists using a scale of 1 to 10. The grade scale is based on powder residues remaining on the inside of the black velvet pouch after the wash process (10—clear, with no visible sign of residues/1—virtually all of the surface is covered with powder residues), the higher the grading number the better dissolution performance. Results of the 2 internal and 2 external replicates were averaged for both test and reference products and reported below.

Test Products:

| LAS/AE1S Ref Agglomerate | |
|---|---|
| Constituent | % w/w Base Powder |
| LAS Linear alkyl benzene sulfonate | 53.0 |
| C12-14 Alkyl Ethoxylate (1) Sulphate | 22.5 |
| Micronised Sodium Sulphate | 9.7 |
| Silica | 14.8 |
| Total | 100 |

Reference Product—Silica and ground sulphate incorporated into the powder during the agglomeration process.

Test Product—10% of total Silica and 8.5% of total Micronized Ground Sulphate was held back during agglomeration process and used to coat the power on completion to produce a more free flowing granule.

Full Powder Composition:

| Constituent | % w/w Base Powder |
|---|---|
| LAS/AE1S Agglomerate | 71.8 |
| Carboxymethyl cellulose (98%) (Finnfix GDA ex CP Kelco) | 1.9 |
| Brightener 49 Tinopal ® CBS-X | 1.3 |
| Texcare SRA300 Soil release polymer | 0.58 |
| Na HEDP Etidronic Acid (86.8%) | 15.3 |
| Zeolite | 2.3 |
| Acusol 4445N Polymer (92.6%) | 4.4 |
| Dow Corning GP-4314 Powdered Antifoam (12% active) | 2.5 |
| Total | 100 |

Water Soluble Unit Dose Articles:

Unit dose articles comprising 12.5 g of reference or test product and M9400 water soluble PVA film, as available from the Monosol LLC company (707 East 80th Place, Suite 301, Merrillville, Ind. 4641) were placed in a 32° C./80% RH oven overnight, removed and left at ambient conditions for 2 hours prior to sewing into the black velvet pouches for dissolution testing.

Results:

The actual grading results in Table 1 clearly show that the Test product comprising free flowing powder according to the invention has an improved dissolution profile vs Reference product. Pictures of the resulting fabrics have also been added to illustrate the actual size of the effect and are shown in FIGS. 1 (reference) and 2 (according to invention).

TABLE 1

| | Reference Product | | | | Test Product | | | |
|---|---|---|---|---|---|---|---|---|
| | Rep 1 | Rep2 | Rep 3 | Rep 4 | Rep1 | Rep2 | Rep3 | Rep 4 |
| Panellist 1 | 5 | 6 | 5 | 4 | 7 | 6 | 8 | 9 |
| Panellist 2 | 4 | 6 | 5 | 3 | 7 | 6 | 8 | 9 |
| Panellist 3 | 5 | 6 | 5 | 3 | 7 | 8 | 9 | 10 |
| Grading Average | | 4.8 | | | | 7.8 | | |

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A water-soluble unit dose article comprising a water-soluble film and a solid particulate laundry detergent composition, wherein the water-soluble film defines a first internal compartment; and wherein the solid particulate laundry detergent composition is comprised within the first internal compartment; and wherein the solid particulate laundry detergent composition is free flowing within the first internal compartment, such that if the water-soluble unit dose article is moved or repositioned, the solid particulate laundry detergent composition can be seen to freely move, or flow within the first internal compartment;

wherein the solid particulate laundry detergent composition comprises particles that are agglomerates, wherein the particles are coated or dusted with sodium sulphate and silica; and wherein the solid particulate laundry detergent composition comprises between 40% and 75%, by weight of the solid laundry detergent composition, of a non-soap anionic surfactant, wherein the non-soap anionic surfactant comprises linear alkylbenzene sulphonate and ethoxylated $C_{12}$-$C_{14}$ alkyl sulphate.

2. The water-soluble unit dose article according to claim 1 wherein the water-soluble unit dose article comprises at least a first compartment and a second compartment.

3. The water-soluble unit dose article according to claim 2 wherein the compartments are arranged in a side-by-side arrangement, a superposed arrangement or a mixture thereof.

4. The water-soluble unit dose article according to claim 3 wherein at least the second compartment is superposed onto the first compartment.

5. The water-soluble unit dose article according to claim 2 wherein the second and subsequent compartments comprise a liquid, a solid or a mixture thereof.

6. The water-soluble unit dose article according to claim 1 wherein the solid particulate laundry detergent composition has a mean particle size of between about 400 microns and about 1000 microns.

7. The water-soluble unit dose article according to claim 6 wherein the solid particulate laundry detergent composition has a mean particle size of between about 450 microns and about 850 microns.

8. The water-soluble unit dose article according to claim 1 wherein the solid particulate laundry detergent composition has a bulk density of between about 400 and about 1000 g/l.

9. The water-soluble unit dose article according to claim 1 wherein the solid particulate laundry detergent composition fills between about 25% and about 95% of the available volume within the first compartment, wherein the remaining volume is filled with gas.

10. The water-soluble unit dose article according to claim 9 wherein the solid particulate laundry detergent composition fills between about 30% and 90% of the available volume within the first compartment, wherein the remaining volume is filled with gas.

11. The water-soluble unit dose article according to claim 1 wherein the first compartment comprises between about 1 g and about 25 g of the solid particulate laundry composition.

12. The water-soluble unit dose article according to claim 11 wherein the first compartment comprises between about 5 g and about 20 g of the solid particulate laundry composition.

13. The water-soluble unit dose article according to claim 1 wherein the water-soluble film comprises a blend of polyvinylalcohol polymers and/or polyvinylalcohol copolymers.

14. The water-soluble unit dose article according to claim 1 wherein the agglomerates comprise the non-soap anionic surfactant, sodium sulphate and silica.

15. A method of washing fabrics which comprises adding the water-soluble unit dose article according to claim 1 to sufficient water to dilute the solid particulate laundry detergent composition by a factor of at least about 300 fold to create a wash liquor and contacting the fabrics to be washed with said wash liquor.

* * * * *